US005501751A

United States Patent [19]

Baldi et al.

[11] Patent Number: 5,501,751

[45] Date of Patent: Mar. 26, 1996

[54] PYROPHOIC MATERIAL AND METHOD FOR MAKING THE SAME

[75] Inventors: Alfonso L. Baldi, Sea Isle City, N.J.; Frank J. Clark, Glasgow, Del.

[73] Assignee: Alloy Surfaces Co. Inc., Wilmington, Del.

[21] Appl. No.: 351,672

[22] Filed: Dec. 8, 1994

[51] Int. Cl.[6] ..... C06B 45/14

[52] U.S. Cl. ..... 149/14; 149/15; 102/335

[58] Field of Search ..... 149/2, 14, 15; 102/335

[56] References Cited

U.S. PATENT DOCUMENTS

| | | | |
|---|---|---|---|
| 3,153,584 | 10/1964 | Goon | 75/5 |
| 3,466,204 | 9/1969 | Gow | 149/3 |
| 3,995,559 | 12/1976 | Bice | 149/15 |
| 4,073,977 | 2/1978 | Koester et al. | 427/216 |
| 4,435,481 | 3/1984 | Baldi | 428/550 |
| 4,533,572 | 8/1985 | Neelameggham et al. | 427/216 |
| 4,541,867 | 9/1985 | Neelameggham et al. | 75/58 |
| 4,880,483 | 11/1989 | Baldi | 149/6 |
| 4,975,299 | 12/1990 | Mir et al. | 427/51 |

OTHER PUBLICATIONS

Stephen C. Davis and Kenneth J. Klabunde, *Unsupported Small Metal Particles: Preparation, Reactivity, and Characterization,* Chemical Reviews, vol. 82, No. 2, Apr. 1982, pp. 153, 200–205.

*Primary Examiner*—Donald P. Walsh
*Assistant Examiner*—Anthony R. Chi
*Attorney, Agent, or Firm*—Connolly and Hutz

[57] ABSTRACT

The present invention is directed to the encapsulation of pyrophoric materials in a high temperature resistant membrane having at least one perforation which allows air to contact the pyrophoric material. By controlling the accessibility of the pyrophoric material to the surrounding air, it is possible to reduce the kinetics of the oxidation reaction without affecting the thermodynamics of the reaction. This results in a product that demonstrates a lower peak temperature, longer dwell time at the lower temperature and, in most cases, an increase in the total heat energy output in comparison to an identical pyrophoric material that is not so encapsulated.

19 Claims, 7 Drawing Sheets

PYROPHOIC MATERIAL AND METHOD FOR MAKING THE SAME

BRIEF DESCRIPTION OF THE INVENTION

The present invention is directed to the encapsulation of pyrophoric materials in a high temperature resistant membrane having at least one perforation which allows air to contact the pyrophoric material. By controlling the accessibility of the pyrophoric material to the surrounding air, it is possible to reduce the kinetics of the oxidation reaction without adversely affecting the thermodynamics of the reaction. This results in a product that demonstrates a lower peak temperature, longer dwell time at the lower temperature and, in most cases, an increase in the total heat energy output in comparison to an identical pyrophoric material that is not so encapsulated.

BACKGROUND OF THE INVENTION

Several types of self-igniting materials are being tested and/or used for dispensable decoy applications to protect defense vehicles including aircraft, ships, tanks, etc. against heat seeking missiles. Included among such materials are activated metals, activated and catalyzed carbon cloth, phosphorous or boron containing wafers or pellets, other non-metallic or metallic pellets or powders and in fact any such material which when exposed to air, instantaneously combines with the oxygen of the air to exothermally form the corresponding material oxide. The heat emitted from the reaction corresponds to the free energy of formation of the metallic or non-metallic oxide formed in the reaction. Many of these materials emit heat in the infra-red region of the electromagnetic spectrum as gray bodies. In some instances, depending upon the material composition or coating applied to the material, they can then selectively emit in a preferred wave band of the infra-red region.

For some decoy applications it would be most desirable to lower the peak temperature of heat emission and increase the dwell time at the lower temperatures without sacrificing the total energy output.

In addition, there are several other applications (e.g., catalysis and controlled bonding processes) where it would be useful to have an expendable body which can either emit heat, or consume oxygen, in a controlled manner.

We have found in laboratory experiments that mixtures of air and an inert gas such as argon will limit the amount or rate of air contacting an activated metal element and cause a reduction in the maximum temperature of emission and give an increase in the dwell time at the lower temperatures. This method, however, in addition to being impractical, presented problems of passivation during the exotherm and markedly reduced the total energy output. It has also been found, as stated in the Baldi U.S. patent application No. 08/152,830, that the addition of chromium to an activated metal element will reduce the peak temperature and extend the lifetime of the element at the lower temperatures but again with a penalty of reducing the total energy output. If by some method the rate of air impinging upon the activated element could be controllably reduced to monitor the kinetics of the oxidation reaction, the objective of lower peak temperature and longer lifetime at the lower temperature could be achieved, providing there was no pronounced effect in reducing the total heat energy output.

SUMMARY OF THE INVENTION

In the present invention we have discovered a unique method to achieve all of the aforementioned objectives with no loss, but in many cases an increase, of the total energy output. We have found specifically that encapsulation of self-igniting materials with a perforated heat resistant membrane such as a thin sheet or layer varying in thickness from about 0.2 mils to more than about 5 mils will minimize the rate at which air can contact the active element and thereby reduce the kinetics of the oxidation reaction without affecting the thermodynamics of the reaction. This results in the encapsulated element demonstrating a lower peak temperature, longer dwell time at the lower temperature and in most cases, an increase in the total heat energy output in comparison to an identical element which is not so encapsulated.

DETAILED DESCRIPTION OF THE INVENTION

Figure 1:
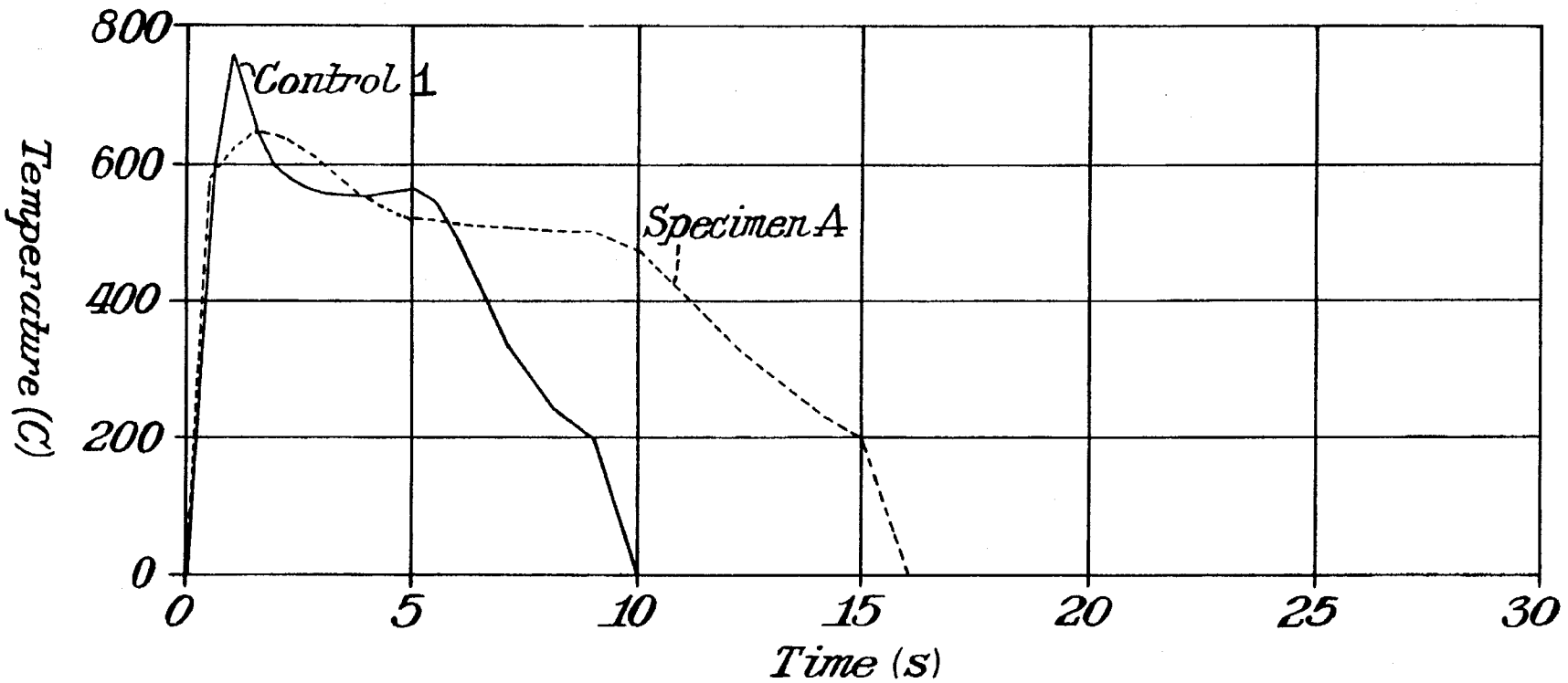
FIG. 1 is a graphical representation of the heat output of the specimens of Example I. The figure shows a graph of Temperature (°C.) vs. Time (seconds). The temperature was obtained by converting the readings obtained with a 3–5 μm radiometer pointed at the specimens (i.e., Specimen A and Control 1) from millivolts (mv) to °C. The temperature indicated is the temperature of the pyrophoric element.

In the present invention we have discovered a unique method to achieve all of the aforementioned objectives with no loss, but in many cases an increase, of the total energy output. We have found specifically that encapsulation of self-igniting materials with a perforated heat resistant membrane such as a thin sheet or layer varying in thickness from about 0.2 mils to more than about 5 mils will minimize the rate at which air can contact the active element and thereby reduce the kinetics of the oxidation reaction without affecting the thermodynamics of the reaction. This results in the encapsulated element demonstrating a lower peak temperature, longer dwell time at the lower temperature and in most cases, an increase in the total heat energy output in comparison to an identical element which is not so encapsulated. Any material (e.g., polymers, metals, ceramics, composites, combinations of these materials, etc.) can be used to form the membrane as long as the material can withstand the temperatures generated by the self-igniting (i.e., pyrophoric) materials during use. In the case of a heat-conducting material such as a metal the heat emitted from the pyrophoric element will in part be conducted away and further lower the peak temperature with some sacrifice such as shorter dwell time and less energy output. In a preferred embodiment of the present invention, the membranes are formed from the higher melting fluoropolymers and heat resistant polyimides. These materials readily meet the high temperature resistance requirement for the membranes. Specifically, some of the fluoropolymers such as the TEFLON® derivatives of DuPont, having melting points greater than about 450° F., which include polytetrafluoroethylene (PTFE) and the copolymer of tetrafluoroethylene and perfluoroalkyoxy resin (PFA), meet the requirement. KAPTON®, a polyimide made by DuPont is unaffected at temperatures as high as about 800° F. and again readily meets the high temperature resistance requirement for this invention. On the other hand polymers such as polyethylene, polypropylene, polyvinylidene chloride and polyesters have melting points below about 300° F. and will not withstand the heat generated from the pyrophoric material and will melt and/or stick to the pyrophoric material and adversely affect its heat output.

Although the membrane can be of virtually any thickness as long as it controls the rate at which air can contact the pyrophoric element, for most applications the thickness of the membrane should be from about 0.2 mils to about 5 mils. In several preferred embodiments of the present invention, the thickness of the membrane is from about 0.2–3 mils. In the most preferred embodiment of the present invention, the membrane is from about 0.5–3 mils.

It is essential that the membrane have a temperature resistance that is high enough to withstand the temperatures generated by the pyrophoric element during the pyrophoric reaction. If the membrane melts (i.e., drips or runs) during the pyrophoric reaction, it will not be an effective membrane. Moreover, if the membrane decomposes during the lifetime of the pyrophoric reaction, it also will not be an effective membrane. For the purposes of the present invention, the membrane is considered to "decompose" if it does not drip or run but instead degrades, either through a chemical reaction or through evaporation or sublimation, to such an extent that it can no longer act as an effective membrane.

The membrane must only be able to demonstrate this temperature resistance for the amount of time that the pyrophoric element is emitting heat. For example, if the pyrophoric element only emits heat for 40 seconds, the membrane must only be able to withstand the heat generated by the element for that period of time. Further, since the heat emitted by the pyrophoric element starts from zero and then reaches a peak before falling back to zero, the time that the membrane will be exposed to a temperature above a certain level (e.g., 150° C.) is less than the total amount of time that the element will be emitting heat. Therefore, if the membrane begins to melt or decompose during the time that the element is emitting heat but does not melt or decompose to the point that it affects the pyrophoric reaction while it is ongoing, then the membrane will be sufficient for the encapsulation of that element. In general, the membrane should be able to withstand the heat from elements whose temperatures are from about 150°–1000° C. (i.e., the temperature is measured from the heat emitting pyrophoric element) for the lifetime of the pyrophoric reaction. In several preferred embodiments of the present invention, the membrane should be able to withstand temperatures of the pyrophoric element of from about 300°–800° C. for the lifetime of the pyrophoric reaction. In the most preferred embodiment of the present invention, the membrane should be able to withstand temperatures of the pyrophoric element of from about 300°–750° C. for the lifetime of the pyrophoric reaction. Typical lifetimes for the pyrophoric elements are from about 10–100 seconds.

In a highly preferred embodiment of the present invention, the membrane contains a selective radiation material. For example, in this embodiment of the present invention, the membrane may contain or be coated with a material that selectively emits in a preferred wave band of the infra-red region while the pyrophoric element is emitting heat. The specific materials that would be used in or on the membrane would depend on the desired wave band and are known to those skilled in this art (e.g., oxides such as $Al_2O_3$, $SiO_2$, $ZrO_2$ or mixtures thereof may be embedded in or coated on the membrane).

In a preferred embodiment of the present invention, the membrane completely encapsulates the pyrophoric element but is not bonded to the pyrophoric element. In this preferred embodiment, the pyrophoric element can either fit snugly within the membrane or it can be free to move around within the membrane. This configuration (i.e., where the membrane is not bonded to the pyrophoric element) permits air to contact all surfaces of the pyrophoric element after passing through the perforations in the membrane. In many applications, this is a very advantageous and desirable feature because it permits the pyrophoric reaction to proceed uniformly along the entire surface of the pyrophoric element. Any means can be used to encapsulate the element within the membrane. For example, the membrane can be in two or more pieces that are connected together to encapsulate the element or the membrane can be one piece of material that is folded over the element and connected to itself to encapsulate the element. In a preferred embodiment, the membrane consists of one piece of material that contains or is coated on at least a portion of its surface with a heat-activated substance (such as thermoplastic or thermosetting resin(s)) that functions to bond the membrane material to itself when the membrane is folded over the element. In this embodiment, the element is placed on the membrane and then the membrane is folded over the element so that the edges of the membrane touch each other with the element encapsulated within the pocket formed by the folded membrane. The edges of the membrane are then exposed to an elevated temperature and, if necessary, pressure so as to activate the heat-activated material and bond the edges of the membrane to each other, thus sealing the element within the membrane.

In another preferred embodiment of the present invention, the membrane consists of two pieces that are bonded or connected to one another to encapsulate the membrane. For example, the element is placed on top of one piece of the membrane and then the second piece of the membrane is placed over the element to form a sandwich with the element between the two pieces of membrane material. The edges of the two pieces of membrane material are then connected to one another by any suitable means, including heating, pressing or a combination of the two.

In a highly preferred embodiment of the present invention, the heat-activated substance that is used to bond the membrane material to itself or to another piece of membrane material is a thermoplastic material such as fluorinated ethylene propylene. In another preferred embodiment of the present invention, the heat-activated substance is a thermosetting material such as an epoxy.

It is also possible to use staples or crimps to connect the edges of the membrane material(s) to each other.

It is essential that the pyrophoric element be larger than the perforations in the membrane so that the element cannot escape from the membrane. Preferably, the pyrophoric element has the shape of a thin disk, a rectangular or square foil or a small cylindrical pellet or sphere. It would not be possible to use a loose pyrophoric powder because:

(1) The powder would be able to escape through the perforations in the membrane; and (2) The powder would react too quickly with the air resulting in either a violent reaction or an ineffective product.

Another important requirement in this invention is the openings or perforations in the resinous membrane which control the passage of air to the self-igniting (i.e., pyrophoric) element. The perforations can be of any shape including circular or oblong holes, slits or any other regular or irregular configuration. The number of the openings per square inch of surface as well as the area of the openings are important in controlling the rate at which air can contact the pyrophoric element. The perforations can be uniformly or randomly distributed throughout the membrane. Once the design of the perforations is established, the total open area or percent of open area of the total surface area of the pyrophoric element or matching membrane will dictate the accessibility of the element to the surrounding air. Further, the total open area (or percent of open area of the total surface area) of the pyrophoric element will establish a characteristic heat output profile for the encapsulated element and thereby establish the maximum temperature as well as the lifetime during which the element is emitting heat.

Total open areas ranging from about one (1) percent to about eighty (80) percent should be effective in this invention. In several preferred embodiments of the present invention, the total open area should be from about 1–60%. In the most preferred embodiment of the present invention, the total open area should be from about 1–40%. In general, the smaller the total open surface area for a given size opening, the lower the peak temperature and the longer the lifetime of the heat emitting pyrophoric material. Lifetime is defined as the length of time during which the pyrophoric element is emitting heat (i.e., which is equivalent to the length of time that the pyrophoric element remains above the temperature of the surrounding environment).

The following examples are intended to illustrate several preferred embodiments of the present invention. The examples should not be interpreted as limiting the scope of the present invention to the specific embodiments described therein.

EXAMPLE I

The following powder admixture was prepared and dispersed in a solvent system consisting of acetone with dissolved acrylate resin to form a coating mixture. The coating mixture was then applied in a continuous dip operation to a 1.5 mil thick plain carbon steel foil stock to a dry coating weight of 7.5 mg/sq. cm.

| | Powder Mixture |
|---|---|
| 130 g | Powdered aluminum (five [5] to ten [10] micron particles) |
| 18 g | Powdered iron (five [5] to ten [10] micron particles) |
| | Solvent |
| 30 g | (95% acetone - 5% acrylate resin) |

Although the coating mixture described in this Example, and the following Examples, uses a solvent system based on an organic solvent (i.e., acetone), a water based solvent system can also be used. For example, the coating mixture of the present Example could have been produced from the following mixture.

| | Powder Mixture |
|---|---|
| 130 g | Powdered aluminum (five [5] to ten [10] micron particles) |
| 18 g | Powdered iron (five [5] to ten [10] micron particles) |
| | Solvent |
| 36.0 g | water |
| 2.5 g | polyvinyl alcohol |
| 36.0 g | n-propanol |

After application of the coating, the coated steel foil was subjected to a temperature of about 1450° F. (788° C.) for ten (10) seconds in a hydrogen atmosphere to cause a reaction with the powder coating and with appreciable diffusion of the aluminum into the underlying steel foil. The foil was next subjected to a leaching solution containing 10% by weight NaOH and ½% by weight $SnCl_2 \cdot 2H_2O$ in water at 170° to 190° F. for ten (10) minutes. The leached foil, in which most of the aluminum had been selectively removed from the coating, was rinsed in water and dried in argon. The final thickness of the now activated foil was 3.8 mils. 1¼" diameter circular specimens were stamped from the activated foil in argon or nitrogen atmosphere. The specimens were tested with and without an encapsulating membrane. Testing consisted of placing each specimen on a test rig in which air was impinged upon the specimen at a flow rate of 6 ft/sec. A 3–5 μm radiometer measured the heat output of the element which was recorded to give its characteristic heat output profile. The peak temperature in °C. and lifetime in seconds as well as the total output energy was determined for each specimen. The lifetime is defined as the total number of seconds during which the specimen is emitting heat and is measured along the base (abscissa) of the profile curve. The total area under the curve is indicative of the total energy output. The quantity X is assigned to the total area under the curve for the control specimen (i.e., the specimen without any membrane encapsulation). The area under the output curve for the encapsulated specimen is determined and is then denoted as a multiple factor of X. The output curves are shown in FIG. 1.

Specimen Identification

Control 1—No encapsulation—Activated steel foil only.

Specimen A—Activated steel foil encapsulated with 2 mil thick polytetrafluoroethylene (PTFE) having a melting point of 600° F. The PTFE membrane was perforated at 26 locations on both sides with each perforation being circular and measuring 0.2 cm (78.7 mils) in diameter, The total open surface area was 12.7%.

Test Results Example I

| Specimen | Percent Open Area | Peak Temperature °C. | Lifetime (seconds) | Total Energy |
|---|---|---|---|---|
| Control 1 | 100 | 764 | 10 | X |
| A | 12.7 | 649 | 17 | 1.6X |

EXAMPLE II

The following powder admixture was prepared and dispersed in a solvent system consisting of acetone with dissolved acrylate resin to form a coating mixture. The coating mixture was then continuously applied to 0.7 mil steel foil stock in a dip operation to give a dry coating weight of 13 mg/sq.cm.

| Powder Mixture | |
|---|---|
| 1125 g | Powdered aluminum (3 to 5 micron particles) |
| 1125 g | Powdered iron (3 to 5 micron particles) |
| 124 g | Powdered copper (about 10 micron particles) |
| 7.6 g | amorphous boron powder |
| 16.6 g | cobalt powder (about 5 micron particles) |
| 24.9 g | nickel powder (about 5 micron particles) |
| Solvent | |
| 100 g | acetone |
| 5 g | acrylate resin |

After application of the coating, the coated steel foil was continuously passed through a production furnace heated to about 1500° F. (816° C.) and with a hydrogen atmosphere so that the coated foil was exposed to the 1500° F. temperature for about five (5) seconds. The exposure of the coated foil to the high temperature caused a reaction between the metal powders in the coating. Most of the reaction took place as an exotherm within the powder itself with only a small amount of diffusion of aluminum into the underlying steel foil to anchor the bulk converted coating (i.e., after the reaction) to the steel foil. The foil was then leached in an aqueous solution containing 20% by weight NaOH and 0.15% by weight $SnCl_2 \cdot 2H_2O$ in water at 170°–190° F. for ten (10) minutes. The leached foil was then rinsed in water and dried in a nitrogen atmosphere. As in Example 1, 1¼" diameter specimens were stamped out of the now activated steel foil. The specimens were tested as described in Example 1.

Specimen Identification

Control 2—No encapsulation—Activated steel only.

Specimen B—Encapsulated with 2 mil PTFE with eight (8), 0.6 cm (236 mil) diameter circular perforations. The total open area was 35.0%.

Specimen C—Same as above (B) but with 26, 0.2 cm (78.7 mil) diameter circular perforations. The total open area was 12.7%.

Specimen D—Same as B but with 26, 0.1 cm (39.4 mil) diameter circular perforations. The total open area was 3.2%.

Test Results Example II

| Specimen | Percent Open Area | Peak Temperature °C. | Lifetime (seconds) | Total Energy |
|---|---|---|---|---|
| Control 2 | 100 | 725+ | 7 | X |
| B | 35 | 705 | 10 | 1.1X |
| C | 12.7 | 672 | 12 | 1.8X |
| D | 3.2 | 506 | 14 | 1.2X |

EXAMPLE III

Figure 2:
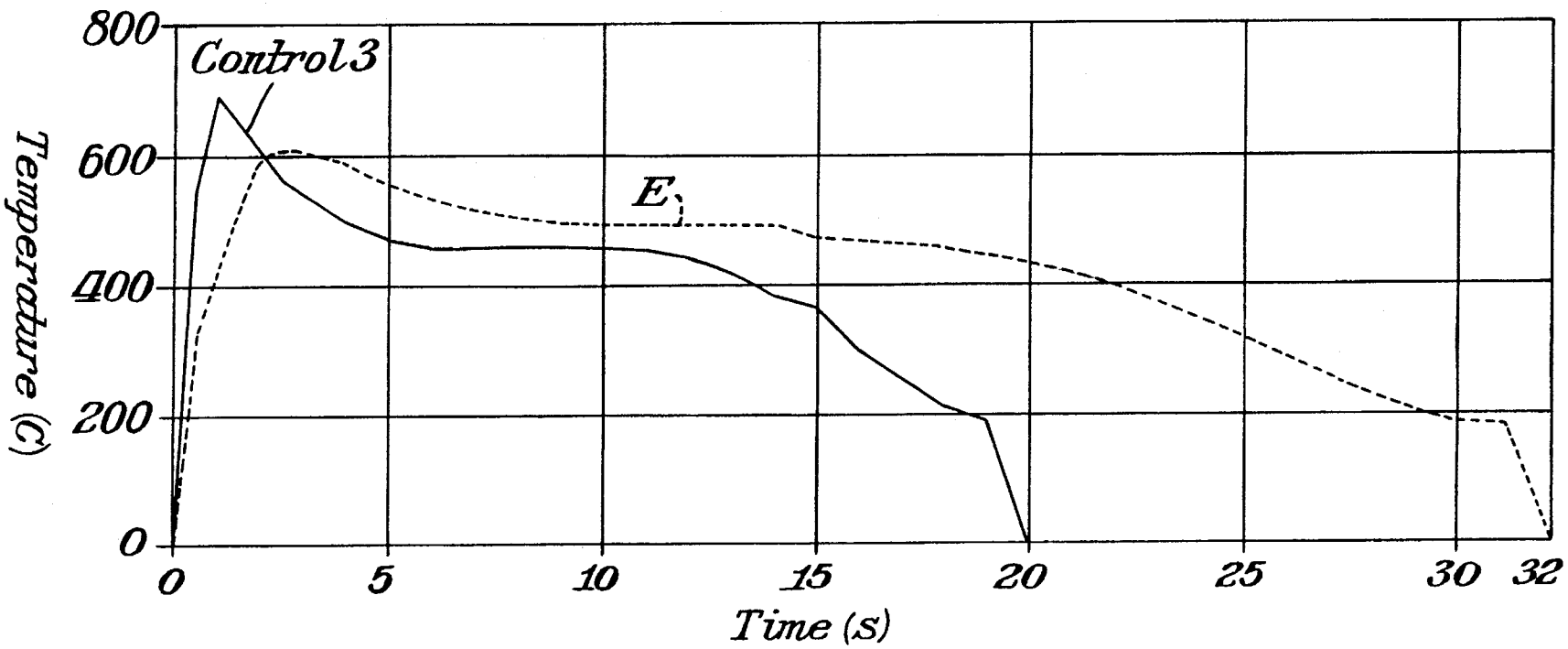
FIG. 2 is a graphical representation of the heat output of the specimens of Example III.

Same as Example I except 3 mil steel foil was coated to give a coating weight of 20 mg/cm$^2$ and a final thickness after activation (leaching out aluminum) of 7 mils. 1¼" diameter specimens were stamped from the activated foil and tested as in Example I. The output profile curves are shown in FIG. 2.

Specimen Identification

Control 3—No encapsulation—Activated steel only.

Specimen E—Encapsulated with 2 mil PTFE and 26, 0.2 cm (78.7 mil) diameter circular holes with total open area of 12.7%.

Test Results Example III

| Specimen | Percent Open Area | Peak Temperature °C. | Lifetime (seconds) | Total Energy |
|---|---|---|---|---|
| Control 3 | 100 | 682 | 20 | X |
| E | 12.7 | 604 | 32 | 1.8X |

Figure 3:
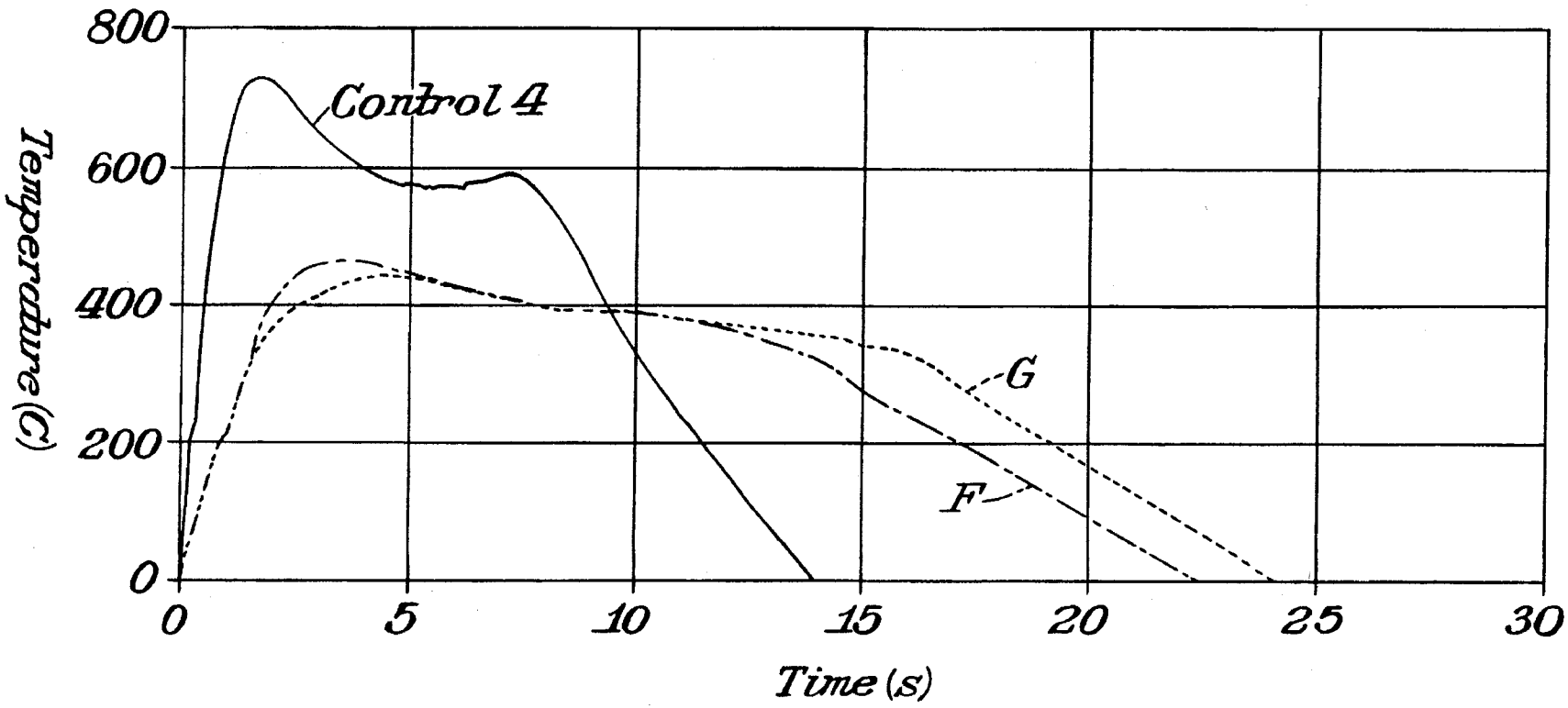
FIG. 3 is a graphical representation of the heat output of the specimens of Example IV.

EXAMPLE IV 1.5 mil steel foil was coated and activated identical to that of Example I. For the encapsulated specimen, 1 mil polyimide (KAPTON®) with 0.004 mil vapor deposited aluminum on one side was used. The output profiles are shown in FIG. 3.

Specimen Identification

Control 4—No encapsulation—Activated steel only.

Specimen F—Encapsulated with 1 mil polyimide (KAPTON®) with one side coated with 0.004 mil aluminum. The membrane was perforated with 0.3 cm diameter circular holes at 26 locations giving a total open area of 28.4%. With this specimen the aluminum coated surface pointed toward the 3–5 μm radiometer and the polyimide surface faced the pyrophoric element.

Specimen G—Same as specimen F except the aluminum coated surface faced the pyrophoric element and the polyimide surface faced the 3–5 μm radiometer. Note that the aluminum in this case tended to reflect the heat (less absorbance than the more heat absorbent polyimide surface) and resulted in a lower peak temperature as shown on the output curve of FIG. 3.

Test Results Example IV

| Specimen | Percent Open Area | Peak Temperature °C. | Lifetime (seconds) | Total Energy |
|---|---|---|---|---|
| Control 4 | 100 | 730 | 14 | X |
| F | 28.4 | 460 | 22.5 | X |
| G | 28.4 | 420 | 24.0 | 1.1X |

EXAMPLE V 28 mil carbon cloth obtained from Siebe Gorman and Co. Ltd. (United Kingdom) which was catalyzed and activated (e.g., as described in commonly owned U.S. Pat. No. 4,799,979—see, for example, column 5, lines 40–64) was tested with and without encapsulation with 2 mil PTFE or 1 mil polyimide with aluminum coating on one side. The same testing as explained in Example I was used. The carbon cloth under those conditions will self-ignite in the air.

Although the use of cloth which has been treated as described above is an example of the present invention, it should be noted that any type of carbon cloth which has been catalyzed and activated so as to be self-igniting in air can be used as the specimen of the present invention.

Specimen Identification

Control 5—No encapsulation—Catalyzed and Activated carbon cloth only.

Specimen H—Encapsulated with 2 mil PTFE with 26, 0.2 cm (78.7 mil) diameter circular perforations with total open area of 12.7%.

Specimen I—Encapsulated with 1 mil polyimide (KAPTON®) coated on one side with 0.004 mil layer of aluminum and perforated the same as specimen H. With the I specimen, the KAPTON® side faced the radiometer and the aluminum coated surface faced the pyrophoric carbon cloth.

Figure 4:
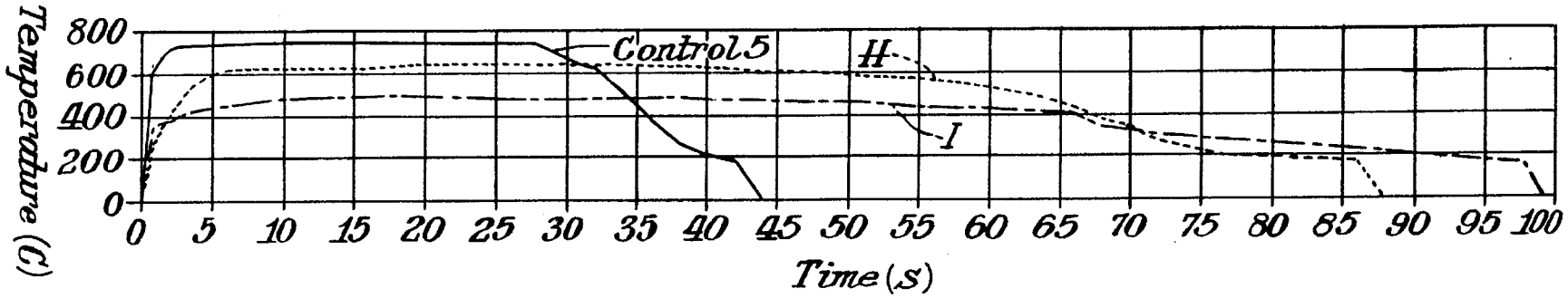
FIG. 4 is a graphical representation of the heat output of the specimens of Example V.

FIG. 4 shows profiles of all specimens.

Test Results Example V

| Specimen | Percent Open Area | Peak Temperature °C. | Lifetime (seconds) | Total Energy |
|---|---|---|---|---|
| Control 5 | 100 | 750 | 44 | X |
| H | 12.7 | 643 | 88 | 1.3X |
| I | 12.7 | 500 | 99 | X |

EXAMPLE VI

Figure 5:
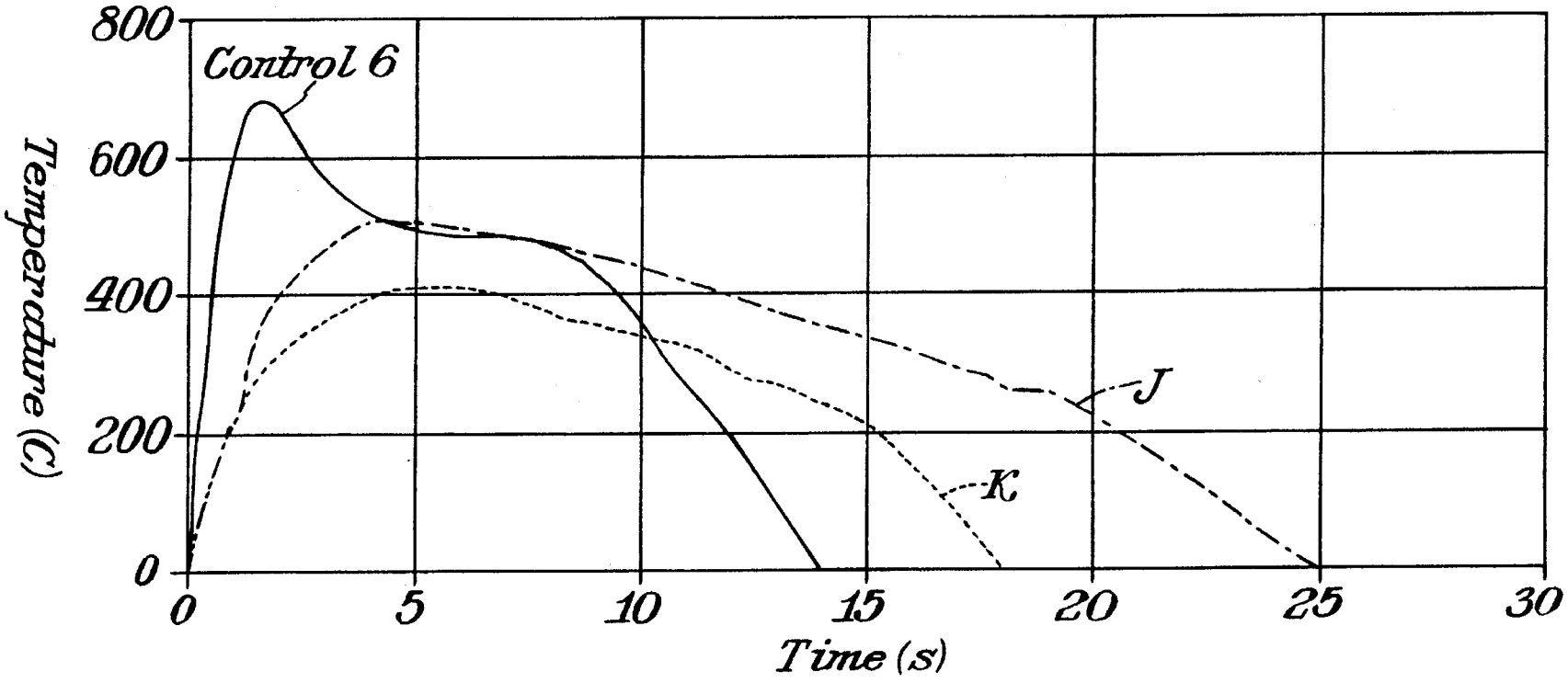
FIG. 5 is a graphical representation of the heat output of the specimens of Example VI.

1½ mil activated steel foil as described in Example I was used as the pyrophoric material. 1¼" diameter foil specimens were tested identical to Example I. FIG. 5 shows profile curve outputs.

Specimen Identification

Control 6—No encapsulation—Activated steel foil only.

J—2 mil PTFE with 13 (0.3 cm) diameter circular holes. 18.5% open area.

K—2 mil PTFE with 1 cm diameter circular hole. 12.0% open area.

Test Results Example VI

| Specimen | Percent Open Area | Peak Temperature °C. | Lifetime (seconds) | Total Energy |
|---|---|---|---|---|
| Control 6 | 100 | 690 | 14 | X |
| J | 18.5 | 500 | 25 | 1.3X |
| K | 12.0 | 405 | 18 | 0.9X |

EXAMPLE VII

Figure 6:
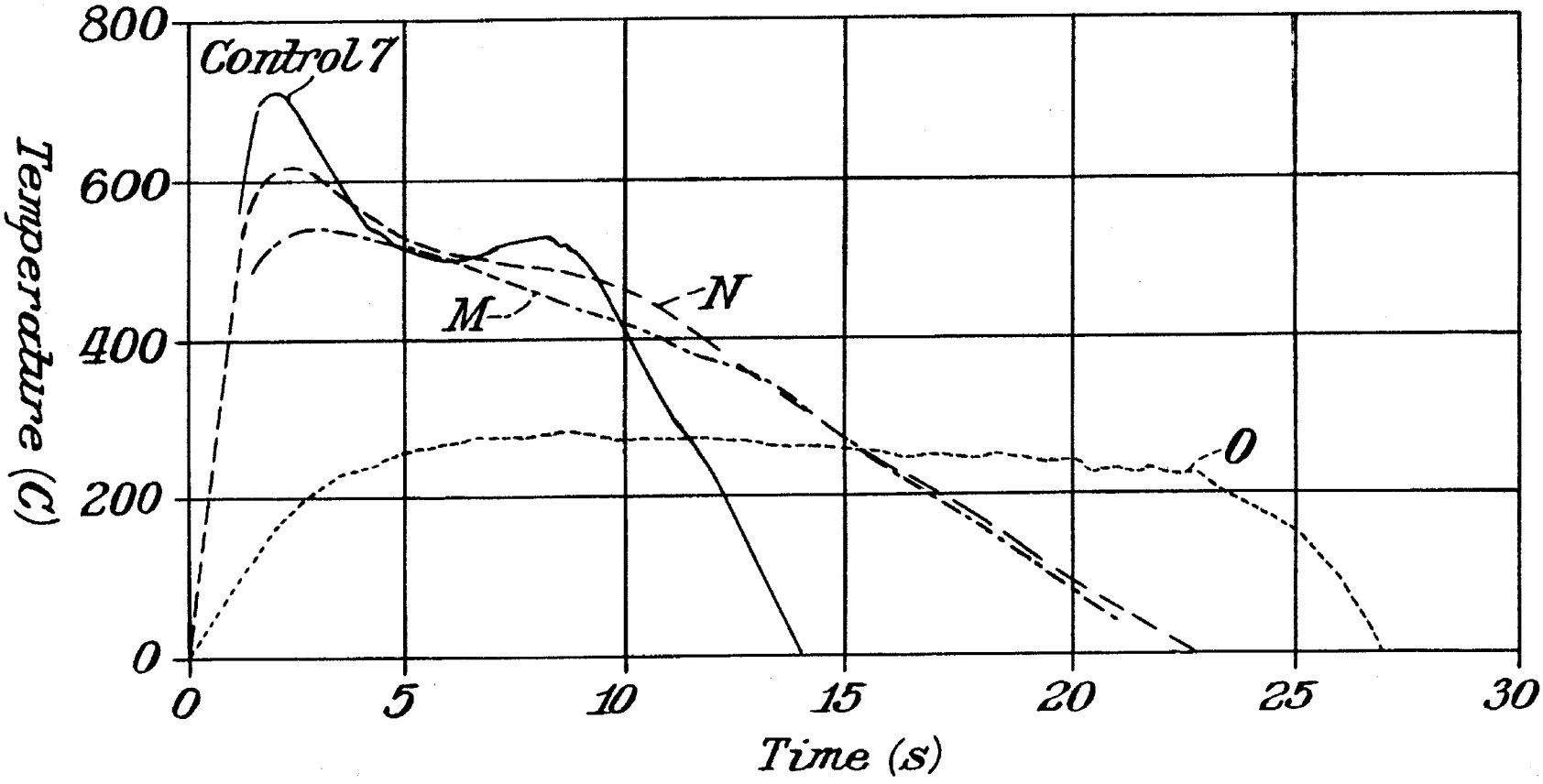
FIG. 6 is a graphical representation of the heat output of the specimens of Example VII.

1½ mil activated steel foil as described in Example I was used as the pyrophoric material. 1¼" diameter specimens without and with encapsulation using perforated polyimide (KAPTON®) having a thickness of 1 mil (i.e., as the encapsulation membrane) was used. FIG. 6 shows the profiles of the output curves.

Specimen Identification

Control 7—No encapsulation. 100% open area.

M—Encapsulated, 26, 0.3 cm diameter circular perforations. 28.5% open area.

N—Encapsulated. 9, 0.6 cm diameter circular perforations. 39.4% open area.

O—Encapsulated. 13, 0.1 cm diameter circular perforations. 1.6% open area.

Test Results Example VII

| Specimen | Percent Open Area | Peak Temperature °C. | Lifetime (seconds) | Total Energy |
|---|---|---|---|---|
| Control 7 | 100 | 710 | 14 | X |
| M | 28.5 | 550 | 22 | 1.2X |
| N | 39.4 | 620 | 22.5 | 1.2X |
| O | 1.6 | 280 | 27.0 | X |

Figure 7:
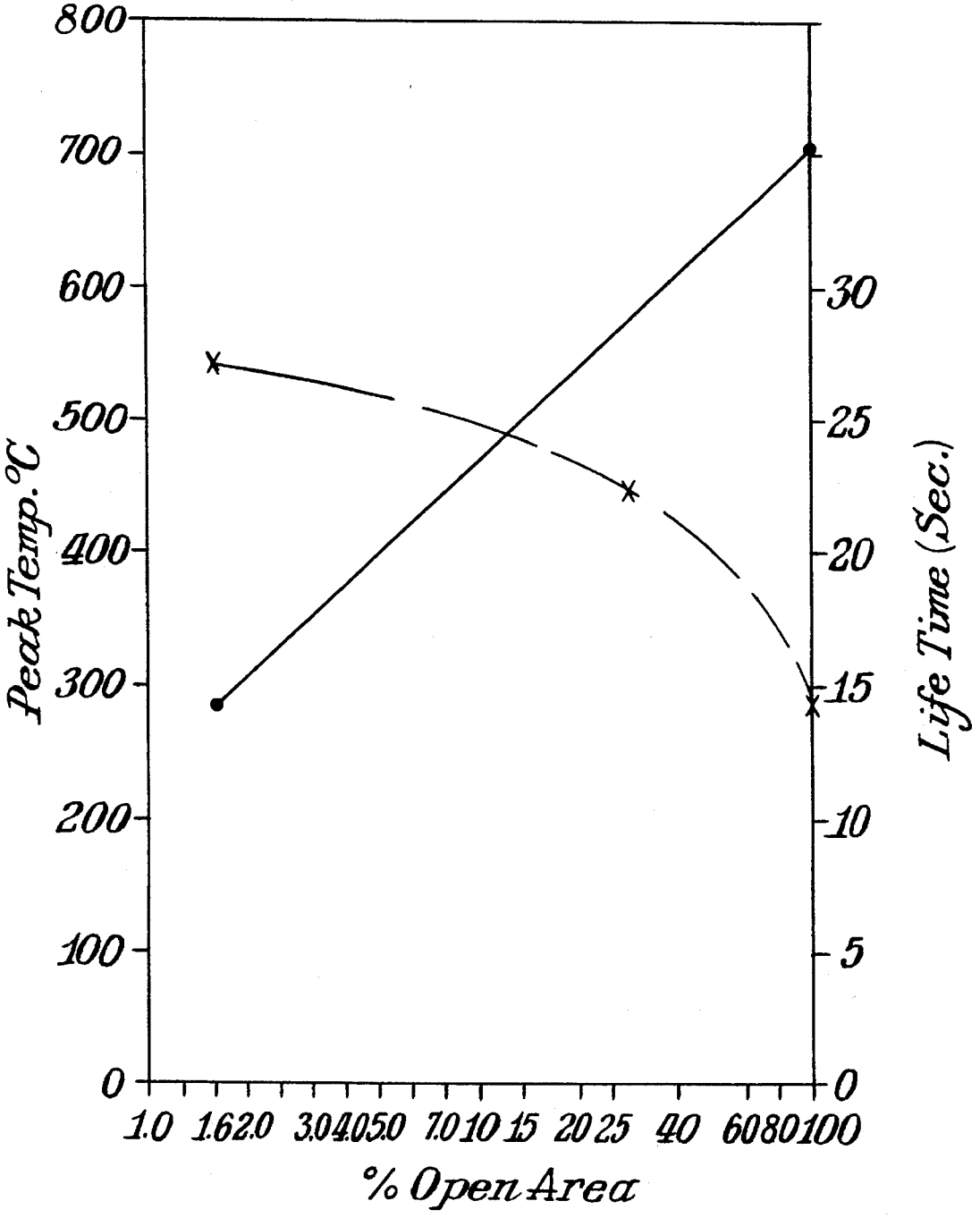
FIG. 7 is a plot of the percent open area versus the peak temperature and lifetime of the specimens of Example VII.

Using the above data, a plot of the percent open area versus the peak temperature and lifetime was made as shown in FIG. 7. Although not shown on the curve, as we approach zero (0) or no perforations, no air will reach the specimen since the membrane is without any effective porosity. In this situation (i.e., when no air reaches the specimen), there is no pyrophoric activity and no heat will be emitted.

Referring to FIG. 7, the lifetime and peak temperature will vary with the pyrophoric material. For example, when encapsulated carbon cloth is used (as can be seen in Example V with 28 mil thick activated carbon cloth), much longer lifetimes are shown because the carbon cloth burns much more slowly than, for example, activated steel foil. Regardless of the identity of the pyrophoric material, a plot of the percent open area versus the peak temperature and lifetime should show the same general trend of percent open area vs. peak temperature and lifetime as shown in FIG. 7.

From the solid line in FIG. 7, we can determine that for an encapsulated specimen with about 10% open area, the peak temperature of the element (measured with a 3–5 μm radiometer) would be about 460° C. Using the broken line (curve) from FIG. 7 in a similar manner, we can determine that the lifetime of the specimen would be about 25 seconds. Further, for an encapsulated specimen with about 5% open area, the peak temperature and lifetime, respectively, would be about 400° C. and 26 seconds. Finally, for an encapsulated specimen with about 2% open area, the peak temperature and lifetime, respectively, would be about 300° C. and 27 seconds.

The following table summarizes the results of examples 1–7.

| Example | Pyrophoric Material | Encapsulating Membrane | Perforation Diameter | No. of perforations per sq. inch | % open area | Peak Temp | Life time | Total Heat Energy Output | Remarks |
|---|---|---|---|---|---|---|---|---|---|
| 1 Control | 1.5 mil Fe | None | | | 100 | 764° C. | 10 sec. | X | |
| 1A | 1.5 mil Fe | 2 mil PTFE | 0.2 cm | 26 | 12.7 | 649° C. | 17 sec. | 1.6X | |
| 2 Control | 0.7 mil Fe | None | | | 100 | 725+° C. | 7 sec. | X | |

-continued

| Example | Pyrophoric Material | Encapsulating Membrane | Perforation Diameter | No. of perforations per sq. inch | % open area | Peak Temp | Life time | Total Heat Energy Output | Remarks |
|---|---|---|---|---|---|---|---|---|---|
| 2B | 0.7 mil Fe | 2 mil PTFE | 0.6 cm | 8 | 35.0 | 705° C. | 10 sec. | 1.1X | |
| 2C | 0.7 mil Fe | 2 mil PTFE | 0.2 cm | 26 | 12.7 | 672° C. | 12 sec. | 1.8X | |
| 2D | 0.7 mil Fe | 2 mil PTFE | 0.1 cm | 26 | 3.2 | 506° C. | 14 sec. | 1.2X | |
| 3 Control | 3.0 mil Fe | None | | | 100 | 682° C. | 20 sec. | X | |
| 3E | 3.0 mil Fe | 2 mil PTFE | 0.2 cm | 26 | 12.7 | 604° C. | 32 sec. | 1.8X | |
| 4 Control | 1.5 mil Fe | None | | | 100 | 730° C. | 14 sec. | X | |
| 4F | 1.5 mil Fe | 1 mil KAPTON ® (polyimide) with one side coated with .004 mil Al. Al faces radiometer | 0.3 cm | 26 | 28.4 | 460° C. | 22.5 sec. | X | KAPTON ® (DuPont) polyimide |
| 4G | 1.5 mil Fe | Same as 4F except polyimide faces radiometer | 0.3 cm | 26 | 28.4 | 420° C. | 24.0 sec. | 1.1X | Al side faces pyrophoric Fe |
| 5 Control | 2 mil ACT carbon cloth | None | | | 100 | 750° C. | 44 | X | |
| 5H | 2 mil ACT carbon cloth | 2 mil PTFE | 0.2 cm | 26 | 12.7 | 643° C. | 88 | 1.3X | |
| 5I | 2 mil ACT carbon cloth | 1 mil polyimide with .004 mil Al on one side, polyimide faces radiometer | 0.2 cm | 26 | 12.7 | 500° C. | 99 | X | Al faces carbon cloth |
| 6 Control | 1.5 mil Fe | None | | | 100 | 690° C. | 14 | X | |
| 6J | 1.5 mil Fe | 2 mil PTFE | 0.3 cm | 13 | 18.5 | 500° C. | 25 | 1.3X | |
| 6K | 1.5 mil Fe | 2 mil PTFE | 1.0 cm | 1 | 12.0 | 405° C. | 18 | 0.9X | |
| 7 Control | 1.5 mil Fe | None | | | 100 | 710° C. | 14 | X | |
| 7M | 1.5 mil Fe | 1 mil polyimide | 0.3 cm | 26 | 28.5 | 550° C. | 22 | 1.2X | |
| 7N | 1.5 mil Fe | 1 mil polyimide | 0.6 cm | 9 | 39.4 | 620° C. | 22.5 | 1.2X | |
| 7O | 1.5 mil Fe | 1 mil polyimide | 0.1 cm | 13 | 1.6 | 280° C. | 27.0 | X | |

What is claimed is:

1. A body comprising a perforated high temperature resistant membrane encapsulating a pyrophoric element.

2. The body of claim 1 in which the membrane is a sheet having a thickness of at least 0.2 mils.

3. The body of claim 2 in which the membrane consists essentially of a fluoropolymer or polyimide.

4. The body of claim 3 in which the fluoropolymer consists essentially of polytetrafluoroethylene, or a copolymer of tetrafluoroethylene and perfluoroalkyoxy resin.

5. The body of claim 1 in which the pyrophoric element comprises at least one material selected from the group consisting of: a self-igniting metal or combination of metals; an activated and catalyzed carbon cloth; a phosphorous containing material; or a boron containing material.

6. The body of claim 1 in which the membrane is coated on one or both sides with a heat sealable resin.

7. The body of claim 1 in which the membrane is coated on one side with a metallic or non-metallic film which when heated can alter the heat-output characteristics of the pyrophoric element.

8. The body of claim 1 in which the membrane comprises a polymeric material which contains a selective radiation material.

9. The body of claim 1 in which the membrane can withstand temperatures of the pyrophoric element of from 150°–1000° C. for from 10–100 seconds without dripping, running or decomposing.

10. The body of claim 2 in which the membrane can withstand temperatures of the pyrophoric element of from 150°–1000° C. for from 10–100 seconds without dripping, running or decomposing.

11. The body of claim 1 in which the membrane can withstand temperatures of the pyrophoric element of from 300°–800° C. for from 10–100 seconds without dripping, running or decomposing.

12. The body of claim 1 in which the membrane can withstand temperatures of the pyrophoric element of from 300°–750° C. for from 10–100 seconds without dripping, running or decomposing.

13. A body comprising a high temperature resistant membrane having at least one perforation passing therethrough, said membrane encapsulating an element which is pyrophoric when exposed to gaseous oxygen.

14. The body of claim 13, wherein said gaseous oxygen contacts said element through said at least one perforation in said membrane.

15. The body of claim 13, wherein said membrane has multiple perforations.

16. A body consisting essentially of:

a) a high temperature resistant membrane having at least one perforation passing therethrough, and b) an element which is pyrophoric when exposed to gaseous oxygen, wherein said membrane encapsulates said element but is not bonded to said element.

17. The body of claim 16, wherein said membrane has multiple perforations.

18. The body of claim 14, wherein said gaseous oxygen is supplied by air.

19. The body of claim 16, wherein said gaseous oxygen is supplied by air.

* * * * *

UNITED STATES PATENT AND TRADEMARK OFFICE

CERTIFICATE OF CORRECTION

PATENT NO. : 5,501,751
DATED : March 26, 1996
INVENTOR(S) : Baldi et al

It is certified that error appears in the above-indentified patent and that said Letters Patent is hereby corrected as shown below:

On the title page: Item [54] and Column 1, line 1, the word "PYROPHOIC" should read --PYROPHORIC--.

In the table at column 11, in the lines identified by Examples 5, 5H and 5I, the pyrophoric material listed in the second column of the table for each of the Examples, 5, 5H and 5I should be changed from "2 mil ACT carbon cloth" to --28 mil ACT carbon cloth--.

Signed and Sealed this

Twentieth Day of August, 1996

Bruce Lehman

*Attest:*

BRUCE LEHMAN

*Attesting Officer*

*Commissioner of Patents and Trademarks*